US009462387B2

(12) United States Patent
Oomen et al.

(10) Patent No.: US 9,462,387 B2
(45) Date of Patent: Oct. 4, 2016

(54) AUDIO SYSTEM AND METHOD OF OPERATION THEREFOR

(75) Inventors: Arnoldus Werner Johannes Oomen, Eindhoven (NL); Dirk Jeroen Breebaart, Eindhoven (NL); Jeroen Gerardus Henricus Koppens, Nederweert (NL); Erik Gosuinus Petrus Schuijers, Oss (NL)

(73) Assignee: Koninklijke Philips N.V., Eindhoven (NL)

( * ) Notice: Subject to any disclaimer, the term of this patent is extended or adjusted under 35 U.S.C. 154(b) by 393 days.

(21) Appl. No.: 13/989,420

(22) PCT Filed: Jan. 3, 2012

(86) PCT No.: PCT/IB2012/050023

§ 371 (c)(1),
(2), (4) Date: May 24, 2013

(87) PCT Pub. No.: WO2012/093352

PCT Pub. Date: Jul. 12, 2012

(65) Prior Publication Data

US 2013/0272527 A1 Oct. 17, 2013

(30) Foreign Application Priority Data

Jan. 5, 2011 (EP) ..... 11150155

(51) Int. Cl.
*H04R 5/00* (2006.01)
*H04R 5/02* (2006.01)
(Continued)

(52) U.S. Cl.
CPC ..... *H04R 5/04* (2013.01); *G10K 15/12* (2013.01); *H04S 3/004* (2013.01)

(58) Field of Classification Search
CPC ..... H04R 5/04; H04S 3/04; G10K 15/12
USPC ..... 381/1, 2, 17, 26, 56, 57, 58, 60, 61, 52, 381/53, 71.11, 104, 107, 111, 309
See application file for complete search history.

(56) References Cited

U.S. PATENT DOCUMENTS 5,544,249 A 8/1996 Opitz
2006/0045294 A1 3/2006 Smyth
(Continued)

FOREIGN PATENT DOCUMENTS

CN 1728234 A 2/2006
EP 1499161 A2 1/2005
(Continued)

OTHER PUBLICATIONS

Menzer et al, "Binaural Reverberation Using a Modified Jot Reverberator With Frequency-Depedent Interaural Coherence Matching", Audio Engineering Society, Convention Paper 7765, May 7-10, 2009, pp. 1-6.
(Continued)

*Primary Examiner* — Vivian Chin
*Assistant Examiner* — William A Jerez Lora

(57) ABSTRACT

An audio system comprises a receiver (301) for receiving an audio signal, such as an audio object or a signal of a channel of a spatial multi-channel signal. A binaural circuit (303) generates a binaural output signal by processing the audio signal. The processing is representative of a binaural transfer function providing a virtual sound source position for the audio signal. A measurement circuit (307) generating measurement data indicative of a characteristic of the acoustic environment and a determining circuit (311) determines an acoustic environment parameter in response to the measurement data. The acoustic environment parameter may typically be a reverberation parameter, such as a reverberation time. An adaptation circuit (313) adapts the binaural transfer function in response to the acoustic environment parameter. For example, the adaptation may modify a reverberation parameter to more closely resemble the reverberation characteristics of the acoustic environment.

18 Claims, 5 Drawing Sheets

(51) Int. Cl.

| | |
|---|---|
| ***H04R 5/04*** | (2006.01) |
| ***G10K 15/12*** | (2006.01) |
| ***H04S 3/00*** | (2006.01) |

(56) References Cited

U.S. PATENT DOCUMENTS

| | | | | |
|---|---|---|---|---|
| 2006/0050909 | A1* | 3/2006 | Kim | H04R 3/02 381/309 |
| 2007/0269053 | A1* | 11/2007 | Meier | H04R 25/70 381/74 |
| 2009/0103738 | A1 | 4/2009 | Faure et al. | |
| 2009/0182563 | A1 | 7/2009 | Schobben et al. | |
| 2010/0027805 | A1 | 2/2010 | Otou et al. | |
| 2011/0150248 | A1* | 6/2011 | Macours | H04S 7/306 381/309 |
| 2011/0211702 | A1* | 9/2011 | Mundt | H04S 3/004 381/17 |

FOREIGN PATENT DOCUMENTS

| | | | |
|---|---|---|---|
| JP | 0787599 | A | 3/1995 |
| JP | 2008512015 | A | 4/2008 |
| JP | 2008513845 | A | 5/2008 |
| JP | 2010035044 | A | 2/2010 |
| WO | 2006126161 | A2 | 11/2006 |
| WO | 2009046909 | A1 | 4/2009 |
| WO | 2009111798 | A2 | 9/2009 |
| WO | 2010012478 | A2 | 2/2010 |

OTHER PUBLICATIONS

Jot, "An Analysis/Synthesis Approach to Real-Time Artificial Reverberation", Proceedings of the International Conference on Acoustics, Speech and Signal Processing, vol. 2, Mar. 23, 1992, pp. 221-224.

Toma et al, "Aspects of Reverberation Algorithms", Signals, Circuits and Systems, International Symposium on IASI, vol. 2, Jul. 14-15, 2005, pp. 577-580.

Toma et al, "On Improved Reverberation Algorithms", 47th International Symposium Elmar, Jun. 2005, pp. 217-220.

International Standard ISO/IEC 23003-1, Part 1: MPEG Surround, 2007, pp. 1-56.

International Standard ISO/IEC 23003-2, Part 2: Sptial Audio Object Coding (SAOC), 2010, pp. 1-11.

Breebaart et al, "Phantom Materialization: A Novel Method to Enhance Stereo Audio Reproduction on Headphones", IEEE Transaction on Audio, Speech and Language Proceesing, vol. 16, 2008, pp. 1503-1511.

Menzer, "Binaural Audio Signal Processing Using Interaural Coherence Matching", PhD Thesis EPFL, Lausanne, Switzerland, 2010, pp. 1-155.

Vesa et al, "Automatic Estimation of Reverberation Time From Binaural Signals", ICASSP, 2005, pp. 111-281-111-284.

Gardner, "Reverberation Algorithms", Appilcation of Digital Signal Processing to Audio and Acoustics, Chapter 3, 1998, pp. 85-131.

Jot, "Digital Delay Networks for Designing Artificial Reverberators", 90th AES Convention, 1991, pp. 1-17.

Menzer et al, "Binaural Reverberation Using a Modified Jot Reverberator With Frequency-Dependent Interaural Coherence Matching", Audio Engineering Society Convention Paper, 2009, pp. 1-6.

* cited by examiner

AUDIO SYSTEM AND METHOD OF OPERATION THEREFOR

FIELD OF THE INVENTION

The invention relates to an audio system and a method of operation therefore and in particular to virtual spatial rendering of audio signals.

BACKGROUND OF THE INVENTION

Spatial sound reproduction beyond simple stereo has become commonplace through applications such as home cinema systems. Typically such systems use loudspeakers positioned at specific spatial positions. In addition, systems have been developed that provide a spatial sound perception from headphones. Conventional stereo reproduction tends to provide sounds that are perceived to originate inside the user's head. However, systems have been developed which provide a full spatial sound perception based on binaural signals provided directly to the user's ears by earphones/headphones. Such systems are often referred to as virtual sound systems as they provide a perception of virtual sound sources at positions where no real sound source exists.

Virtual surround sound is a technology that attempts to create the perception that there are sound sources surrounding the listener which are not physically present. In such systems, the sound does not appear to originate from inside the user's head as is known from conventional headphone reproduction systems. Rather, the sound may be perceived to originate outside the user's head, as is the case in natural listening in absence of headphones. In addition to a more realistic experience, virtual surround audio also tends to have a positive effect on listener fatigue and speech intelligibility.

In order to achieve this perception, it is necessary to employ some means of tricking the human auditory system into thinking that a sound is coming from the desired positions. A well-known approach for providing the experience of virtual surround sound is the use of binaural recording. In such approaches, the recording of sound uses a dedicated microphone arrangement and is intended for replay using headphones. The recording is either made by placing microphones in the ear canal of a subject or a dummy head, which is a bust that includes pinnae (outer ears). The use of such a dummy head including pinnae provides a very similar spatial impression to the impression the person listening to the recordings would have if present during the recording. However, because each person's pinnae are unique, and the filtering they impose on sound depends on the directional incidence of the incoming soundwave is accordingly also unique, localization of sources is subject dependent. Indeed, the specific features used to localize sources are learned by each person from early childhood. Therefore, any mismatch between pinnae used during recording and those of the listener may lead to a degraded perception, and erroneous spatial impressions.

By measuring the impulse responses from a sound source at a specific location in three dimensional space to the microphones in the dummy head's ears for each individual, the so called Head Related Impulse Responses (HRIR) can be determined. HRIRs can be used to create a binaural recording simulating multiple sources at various locations. This can be realized by convolving each sound source with the pair of HRIRs that corresponds to the position of the sound source. The HRIR may also be referred to as a Head Related Transfer Function (HRTF). Thus, the HRTF and HRIR are equivalents. In the case that the HRIR also includes a room effect these are referred to as Binaural Room Impulse Responses (BRIRs). BRIRs consist of an anechoic portion that only depends on the subject's anthropometric attributes (such as head size, ear shape, etc), followed by a reverberant portion that characterizes the combination of the room and the anthropometric properties.

The reverberant portion contains two temporal regions, usually overlapping. The first region contains so-called early reflections, which are isolated reflections of the sound source on walls or obstacles inside the room before reaching the ear-drum (or measurement microphone). As the time lag increases, the number of reflections present in a fixed time interval increases, now also containing higher-order reflections.

The second region in the reverberant portion is the part where these reflections are not isolated anymore. This region is called the diffuse or late reverberation tail. The reverberant portion contains cues that give the auditory system information about distance of the source and size and acoustical properties of the room. Furthermore it is subject dependent due to the filtering of the reflections with the HRIRs. The energy of the reverberant portion in relation to that of the anechoic portion largely determines the perceived distance of the sound source. The density of the (early-) reflections contributes to the perceived size of the room. The $T_{60}$ reverberation time is defined as the time it takes for reflections to drop 60 dB in energy level. The reverberation time gives information on the acoustical properties of the room; whether its walls are very reflective (e.g. bathroom) or whether there is much absorption of sound (e.g. bed-room with furniture, carpet and curtains), as well as the volume (size) of the room.

Besides the use of measured impulse responses incorporating a certain acoustic environment, synthetic reverberation algorithms are often employed, because of the ability to modify certain properties of the acoustic simulation, and because of their relatively low computational complexity.

An example of a system that uses virtual surround techniques is MPEG Surround which is one of the major advances in multi-channel audio coding recently standardized by MPEG (ISO/IEC 23003-1:2007, MPEG Surround).

MPEG Surround is a multi-channel audio coding tool that allows existing mono- or stereo-based coders to be extended to multi-channel. FIG. 1 illustrates a block diagram of a stereo core coder extended with MPEG Surround. First the MPEG Surround encoder creates a stereo downmix from the multi-channel input signal. The stereo downmix is coded into a bit-stream using a core encoder, e.g. HE-AAC. Next, spatial parameters are estimated from the multi-channel input signal. These parameters are encoded into a spatial bit-stream. The resulting core coder bit-stream and the spatial bit-stream are merged to create the overall MPEG Surround bit-stream. Typically the spatial bit-stream is contained in the ancillary data portion of the core coder bit-stream. At the decoder side, the core and spatial bit-stream are first separated. The stereo core bit-stream is decoded in order to reproduce the stereo downmix. This downmix together with the spatial bit-stream is input to the MPEG Surround decoder. The spatial bit-stream is decoded resulting in the spatial parameters. The spatial parameters are then used to upmix the stereo downmix in order to obtain the multi-channel output signal which is an approximation of the original multi-channel input signal.

Since the spatial image of the multi-channel input signal is parameterized, MPEG Surround also allows for decoding of the same multi-channel bit-stream onto rendering devices other than a multichannel speaker setup. An example is virtual reproduction on headphones, which is referred to as the MPEG Surround binaural decoding process. In this mode a realistic surround experience can be provided using regular headphones.

FIG. 2 illustrates a block diagram of the stereo core codec extended with MPEG Surround where the output is decoded to binaural. The encoder process is identical to that of FIG. 1. After decoding the stereo bit-stream, the spatial parameters are combined with the HRTF/HRIR data to produce the so-called binaural output.

Building upon the concept of MPEG Surround, MPEG has standardized a 'Spatial Audio Object Coding' (SAOC) (ISO/IEC 23003-2:2010, Spatial Audio Object Coding).

From a high level perspective, in SAOC, instead of channels, sound objects are efficiently coded. Whereas in MPEG Surround, each speaker channel can be considered to originate from a different mix of sound objects, in SAOC these individual sound objects are, to some extent, available at the decoder for interactive manipulation. Similarly to MPEG Surround, a mono or stereo downmix is also created in SAOC where the downmix is coded using a standard downmix coder, such as HE-AAC. Object parameters are encoded and embedded in the ancillary data portion of the downmix coded bitstream. At the decoder side, by manipulation of these parameters, the user can control various features of the individual objects, such as position, amplification/attenuation, equalization, and even apply effects such as distortion and reverb.

The quality of virtual surround rendering of stereo or multichannel content can be significantly improved by so-called phantom materialization, as described in Breebaart, J., Schuijers, E. (2008). "Phantom materialization: A novel method to enhance stereo audio reproduction on headphones." IEEE Trans. On Audio, Speech and Language processing 16, 1503-1511.

Instead of constructing a virtual stereo signal by assuming two sound sources originating from the virtual loudspeaker positions, the phantom materialization approach decomposes the sound signal into a directional signal component and an indirect/decorrelated signal component. The direct component is synthesized by simulating a virtual loudspeaker at the phantom position. The indirect component is synthesized by simulating virtual loudspeakers at the virtual direction(s) of the diffuse sound field. The phantom materialization process has the advantage that it does not impose the limitations of a speaker setup onto the virtual rendering scene.

Virtual spatial sound reproduction has been found to provide very attractive spatial experiences in many scenarios. However, it has also been found that the approach may in some scenarios result in experiences that do not completely correspond to the spatial experience that would result in a real world scenario with actual sound sources at the simulated positions in three dimensional space.

It has been suggested that the spatial perception of virtual audio rendering may be affected by interference in the brain between the positional cues provided by the audio and the positional cues provided by the user's vision.

In daily life, visual cues are (typically subconsciously) combined with audible cues to enhance the spatial perception. One example is that a person's intelligibility increases when his lip movements can also be observed. In another example, it has been found that a person can be tricked by providing a visual cue to support a virtual sound source, e.g. by placing a dummy speaker at a location where a virtual sound source is generated. The visual cue will thus enhance or modify the virtualization. A visual cue can to a certain extent even change the perceived location of a sound source as in the case of a ventriloquist. Conversely, the human brain has trouble in localizing sound sources that do not have a supporting visual cue (for instance in wavefield synthesis), which is actually contradictory to human nature.

Another example is the leakage of external sound sources from the listener's environment that are mixed with the virtual sound sources generated by a headphone-based audio system. Depending on the audio content and user location, the acoustic properties of the physical and virtual environments may differ considerably, resulting in ambiguity with respect to the listening environment. Such mixtures of acoustical environments may cause unnatural and unrealistic sound reproduction.

There are still many aspects related to the interaction with visual cues that are not well understood, and indeed the effect of visual cues in relation to virtual spatial sound reproduction is not fully understood.

Hence, an improved audio system would be advantageous and in particular an approach allowing increased flexibility, facilitated implementation, facilitated operation, improved spatial user experience, improved virtual spatial sound generation and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided audio system comprising: a receiver for receiving an audio signal; a binaural circuit for generating a binaural output signal by processing the audio signal, the processing being representative of a binaural transfer function providing a virtual sound source position for the audio signal; a measurement circuit for generating measurement data indicative of a characteristic of an acoustic environment; a determining circuit for determining an acoustic environment parameter in response to the measurement data; and an adaptation circuit for adapting the binaural transfer function in response to the acoustic environment parameter.

The invention may provide an improved spatial experience. In many embodiments, a more natural spatial experience may be perceived and the sound reproduction may seem less artificial. Indeed, the virtual sound characteristics may be adapted to be more in line with other positional cues, such as visual cues. A more realistic spatial sound perception may thus be achieved with the user being provided with a virtual sound reproduction that seems more natural and with an improved externalisation.

The audio signal may correspond to a single sound source and the processing of the audio signal may be such that the audio represented by the audio signal is rendered from a desired virtual position for the sound source. The audio signal may for example correspond to a single audio channel (such as a sound channel of a surround sound system) or may e.g. correspond to a single audio object. The audio signal may specifically be a single channel audio signal from a spatial multichannel signal. Each spatial signal may be processed to be rendered such that it is perceived to originate from a given virtual position.

The audio signal may be represented by a time domain signal, a frequency domain signal and/or a parameterised signal (such as an encoded signal). As a specific example, the audio signal may be represented by data values in a time-frequency tile format. In some embodiments, the audio signal may have associated position information. For example, an audio object may be provided with positional information indicating an intended sound source position for the audio signal. In some scenarios, the position information may be provided as spatial upmix parameters. The system may be arranged to further adapt the binaural transfer function in response to the position information for the audio signal. For example, the system may select the binaural transfer function to provide a sound positional cue corresponding to the indicated position.

The binaural output signal may comprise signal components from a plurality of audio signals, each of which may have been processed in accordance with a binaural transfer function, where the binaural transfer function for each audio signal may correspond to the desired position for that audio signal. Each of the binaural transfer functions may in many embodiments be adapted in response to the acoustic environment parameter.

The processing may specifically apply the binaural transfer function to the audio signal or a signal derived therefrom (e.g. by amplification, processing etc.). The relationship between the binaural output signal and the audio signal is dependent on/reflected by the binaural transfer function. The audio signal may specifically generate a signal component for the binaural output signal which corresponds to applying a binaural transfer function to the audio signal. The binaural transfer function may thus correspond to the transfer function applied to the audio signal to generate a binaural output signal which provides a perception of the audio source being at a desired position. The binaural transfer function may include a contribution from or correspond to an HRTF, HRIR or BRIR.

The binaural transfer function may be applied to the audio signal (or a signal derived therefrom) by applying the binaural transfer function in the time domain, in the frequency domain or as a combination of both. For example, the binaural transfer function may be applied to time frequency tiles, e.g. by applying a complex binaural transfer function value to each time frequency tile. In other examples, the audio signal may be filtered by a filter implementing the binaural transfer function.

In accordance with an optional feature of the invention, the acoustic environment parameter comprises a reverberation parameter for the acoustic environment.

This may allow a particularly advantageous adaptation of the virtual sound to provide an improved and typically more natural user experience from a sound system using virtual sound source positioning.

In accordance with an optional feature of the invention, the acoustic environment parameter comprises at least one of: a reverberation time; a reverberation energy relative to a direct path energy; a frequency spectrum of at least part of a room impulse response; a modal density of at least part of a room impulse response; an echo density of at least part of a room impulse response; an inter-aural coherence or correlation; a level of early reflections; and a room size estimate.

These parameters may allow a particularly advantageous adaptation of the virtual sound to provide an improved and typically more natural user experience from a sound system using virtual sound source positioning. Furthermore, the parameters may facilitate implementation and/or operation.

In accordance with an optional feature of the invention, the adaptation circuit is arranged to adapt a reverberation characteristic of the binaural transfer function.

This may allow a particularly advantageous adaptation of the virtual sound to provide an improved and typically more natural user experience from a sound system using virtual sound source positioning. The approach may allow facilitated operation and/or implementation as reverberation characteristics are particularly suited for adaptation. The modification may be such that the processing is modified to correspond to a binaural transfer function with different reverberation characteristics.

In accordance with an optional feature of the invention, the adaptation circuit is arranged to adapt at least one of the following characteristics of the binaural transfer function: a reverberation time; a reverberation energy relative to a direct sound energy; a frequency spectrum of at least part of the binaural transfer function; a modal density of at least part of the binaural transfer function; an echo density of at least part of the binaural transfer function; an inter-aural coherence or correlation; and a level of early reflections of at least part of the binaural transfer function.

These parameters may allow a particularly advantageous adaptation of the virtual sound to provide an improved and typically more natural user experience from a sound system using virtual sound source positioning. Furthermore, the parameters may facilitate implementation and/or operation.

In accordance with an optional feature of the invention, the processing comprises a combination of a predetermined binaural transfer function and a variable binaural transfer function adapted in response to the acoustic environment parameter.

This may in many scenarios provide a facilitated and/or improved implementation and/or operation. The predetermined binaural transfer function and the variable binaural transfer function may be combined. For example, the transfer functions may be applied to the audio signal in series or may be applied to the audio signal in parallel with the resulting signals being combined.

The predetermined binaural transfer function may be fixed and may be independent of the acoustic environment parameter. The variable binaural transfer function may be an acoustic environment simulation transfer function.

In accordance with an optional feature of the invention, the adaptation circuit is arranged to dynamically update the binaural transfer function.

The dynamic update may be in real time. The invention may allow a system that automatically and continuously adapts the sound provision to the environment it is used in. For example, as a user carrying the audio system moves, the sound may automatically adapt the rendered audio to match the specific acoustic environment, e.g. to match the specific room. The measurement circuit may continuously measure the environment characteristic and the processing may continuously be updated in response thereto.

In accordance with an optional feature of the invention, the adaptation circuit is arranged to modify the binaural transfer function only when the environment characteristic meets a criterion.

This may provide an improved user experience in many scenarios. In particular, it may in many embodiments provide a more stable experience. The adaptation circuit may for example only modify a characteristic of the binaural transfer function when the audio environment parameter meets a criterion. The criterion may for example be that a difference between the value of the acoustic environment parameter and the previous value used to adapt the binaural transfer function exceeds a threshold.

In accordance with an optional feature of the invention, the adaptation circuit is arranged to restrict a transition speed for the binaural transfer function.

This may provide an improved user experience and may make the adaptation to specific environment conditions less noticeable. Modifications of the binaural transfer function may be made subject to a low pass filtering effect with attenuation of changes above often advantageously 1 Hz. For example, step changes to the binaural transfer function may be restricted to be gradual transitions with durations of around 1-5 seconds.

In accordance with an optional feature of the invention, the audio system further comprises: a data store for storing binaural transfer function data; a circuit for retrieving binaural transfer function data from the data store in response to the acoustic environment parameter; and wherein the adaptation circuit is arranged to adapt the binaural transfer function in response to the retrieved binaural transfer function data.

This may provide a particularly efficient implementation in many scenarios. The approach may specifically reduce computational resource requirements.

In some embodiments, the audio system may further comprise a circuit for detecting that no binaural transfer function data stored in the data store is associated with acoustic environment characteristics corresponding to the acoustic environment parameter, and in response to generate and store binaural transfer function data in the data store together with associated acoustic environment characterizing data.

In accordance with an optional feature of the invention, the audio system further comprises: a test signal circuit arranged to radiate a sound test signal into the acoustic environment; and wherein the measurement circuit is arranged to capture a received sound signal in the environment, the received audio signal comprising a signal component arising from the radiated sound test signal; and the determining circuit is arranged to determine the acoustic environment parameter in response to the sound test signal.

This may provide a low complexity, yet accurate and practical way of determining the acoustic environment parameter. The determination of the acoustic environment parameter may specifically be in response to a correlation between the received test signal and the audio test signal. For example, frequency or time characteristics may be compared and used to determine the acoustic environment parameter.

In accordance with an optional feature of the invention, the determining circuit is arranged to determine an environment impulse response in response to the received sound signal and to determine the acoustic environment parameter in response to the environment impulse response.

This may provide a particularly robust, low complexity and/or accurate approach for determining the acoustic environment parameter.

In accordance with an optional feature of the invention, the adaptation circuit is further arranged to update the binaural transfer function in response to a user position.

This may provide a particularly attractive user experience. For example, the virtual sound rendering may continuously be updated as the user moves, thereby providing a continuous adaptation not only to e.g. the room but also to the user's position in the room.

In some embodiments, the acoustic environment parameter is dependent on a user position.

This may provide a particularly attractive user experience. For example, the virtual sound rendering may continuously be updated as the user moves thereby providing a continuous adaptation not only to e.g. the room but also to the user's position in the room. As an example, the acoustic environment parameter may be determined from a measured impulse response which may dynamically change as a user moves within an environment. The user position may be a user orientation or location.

In accordance with an optional feature of the invention, the binaural circuit comprises a reverberator; and the adaptation circuit is arranged to adapt a reverberation processing of the reverberator in response to the acoustic environment parameter.

This may provide a particularly practical approach for modifying the processing to reflect modified binaural transfer functions. The reverberator may provide a particularly efficient approach for adapting the characteristics yet be sufficiently simple to control. The reverberator may for example be a Jot reverberator as e.g. described in J.-M. Jot and A. Chaigne, "Digital delay networks for designing artificial reverberators," Audio Engineering Society Convention, February 1991.

According to an aspect of the invention there is provided method of operation for an audio system, the method comprising: receiving an audio signal; generating a binaural output signal by processing the audio signal, the processing being representative of a binaural transfer function providing a virtual sound source position for the audio signal; generating measurement data indicative of a characteristic of an acoustic environment; determining an acoustic environment parameter in response to the measurement data; and adapting the binaural transfer function in response to the acoustic environment parameter.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

Figure 1:
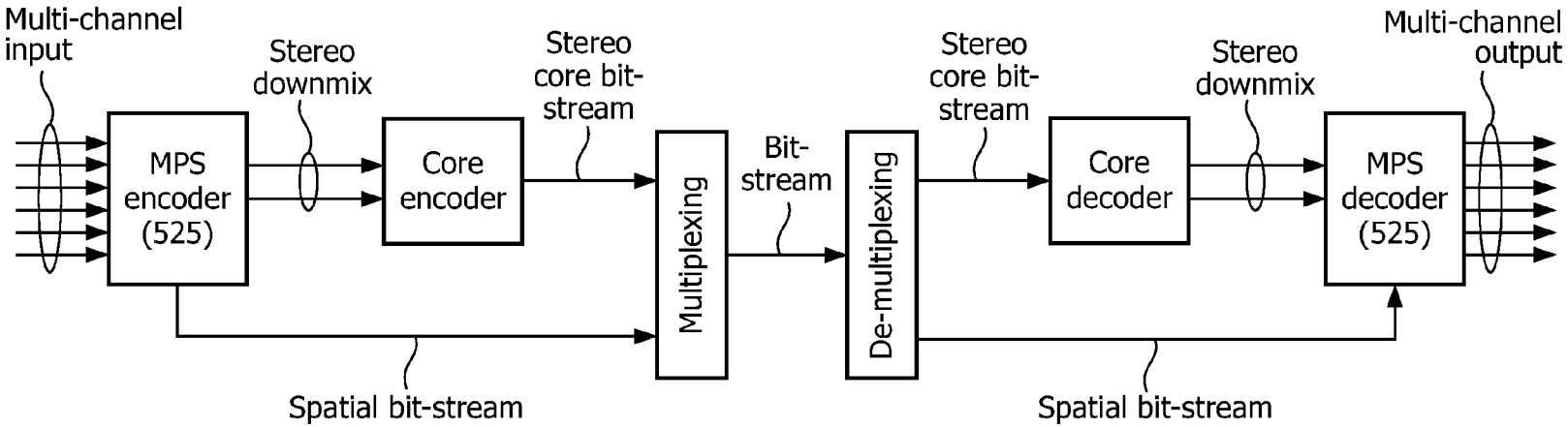
FIG. 1 illustrates a block diagram of a stereo core codec extended with MPEG Surround.
Figure 2:
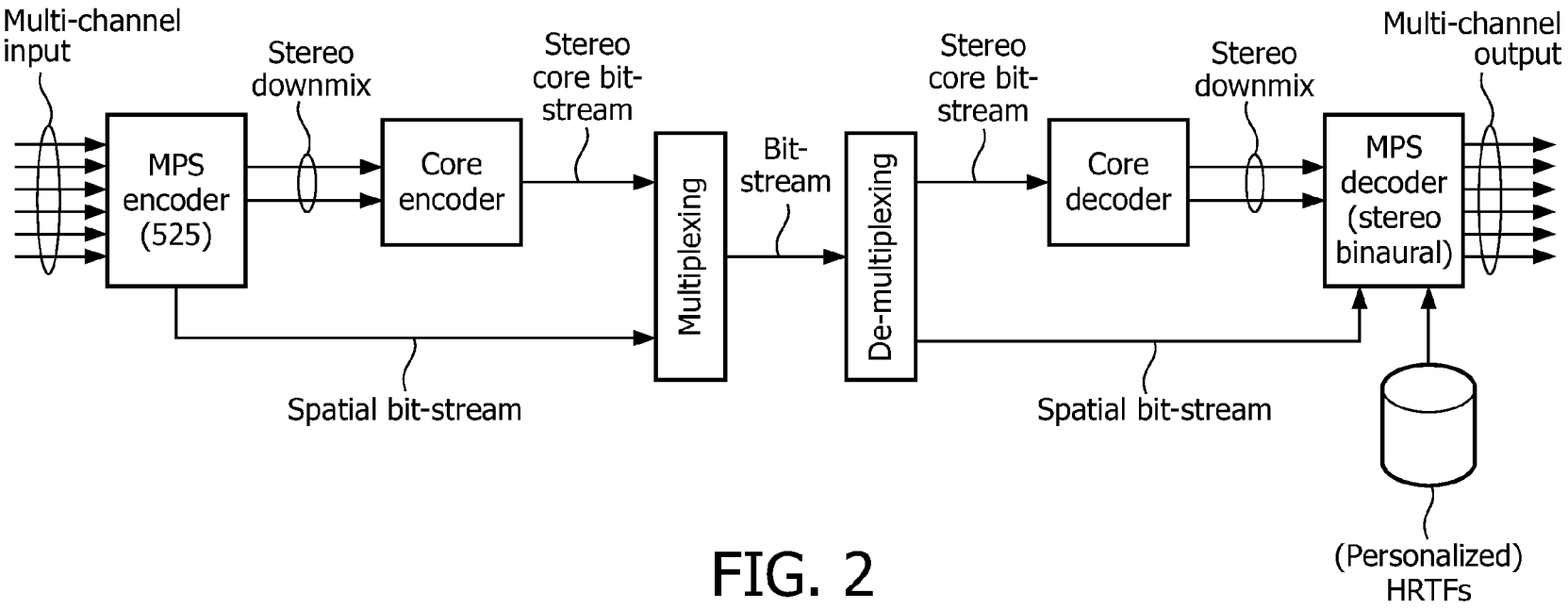
FIG. 2 illustrates a block diagram of a stereo core codec extended with MPEG Surround and providing a binaural output signal.
Figure 3:
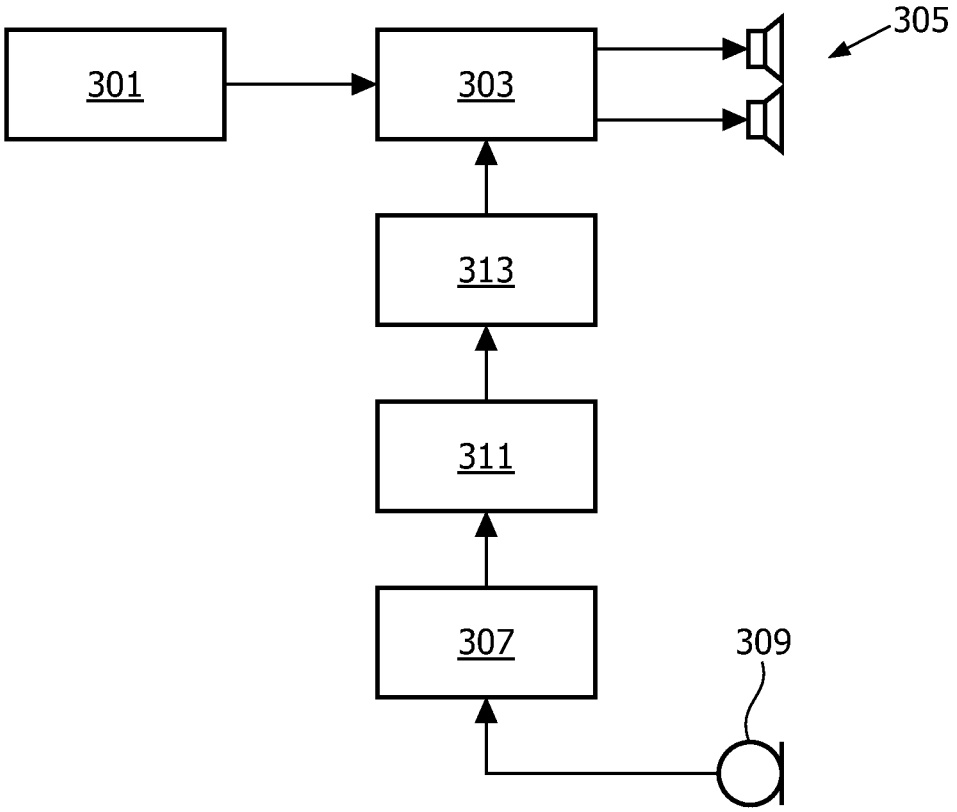
FIG. 3 illustrates an example of elements of an audio system in accordance with some embodiments of the invention.

FIG. 3 illustrates an example of an audio system in accordance with some embodiments of the invention. The audio system is a virtual sound system which emulates spatial sound source positions by generating a binaural signal which comprises a signal for each ear of a user. Typically, the binaural audio is provided to the user via a pair of headphones, earphones or similar.

The audio system comprises a receiver 301 which receives an audio signal which is to be rendered by the audio system. The audio signal is intended to be rendered as a sound source with a desired virtual position. Thus, the audio system renders the audio signal such that the user (at least approximately) perceives the signal to originate from the desired position or at least direction.

In the example, the audio signal is thus considered to correspond to a single audio source. As such, the audio signal is associated with one desired position. The audio signal may correspond to e.g. a spatial channel signal and specifically the audio signal may be a single signal of a spatial multi-channel signal. Such a signal may implicitly have a desired associated position. For example, a central channel signal is associated with a position straight ahead of the listener, a front left channel is associated with a position forward and to the left of the listener, a rear left signal is associated with a position behind and to the left of the listener etc. The audio system may thus render this signal to appear to arrive from this position.

As another example, the audio signal may be an audio object and may for example be an audio object that the user can freely position in (virtual) space. Thus, in some examples the desired position may be locally generated or selected e.g. by the user.

The audio signal may for example be represented, provided and/or processed as a time domain signal. Alternatively or additionally the audio signal may be provided and/or processed as a frequency domain signal. Indeed, in many systems the audio system may be able to switch between such representations and apply the processing in the domain which is most efficient for the specific operation.

In some embodiments, the audio signal may be represented as a time-frequency tile signal. Thus, the signal may be divided up into tiles where each tile corresponds to a time interval and a frequency interval. For each of these tiles, the signal may be represented by a set of values. Typically, a single complex signal value is provided for each time-frequency tile.

In the description, a single audio signal is described and processed to be rendered from a virtual position. However, it will be appreciated that in most examples, the sound rendered to the listener comprises sounds from many different sound sources. Thus, in typical embodiments, a plurality of audio signals are received and rendered, typically from different virtual positions. For example, for a virtual surround sound system, typically a spatial multi-channel signal is received. In such scenarios, each signal is typically processed individually as described in the following for the single audio signal and are then combined. Of course, the different signals are typically rendered from different positions and thus different binaural transfer positions may be applied.

Similarly, in many embodiments, a large number of audio objects may be received and each of these (or a combination of these) may be individually processed as described.

For example, it is possible to render a combination of objects or signals with a combination of binaural transfer functions such that each object in the combination of objects is rendered differently, e.g. at different locations. In some scenarios, a combination of audio objects or signals may be processed as a combined entity. E.g. the downmix of the front- and surround left channels can be rendered with a binaural transfer function that consists of a weighted mix of the two corresponding binaural transfer functions.

The output signals may then simply be generated by combining (e.g. adding) the binaural signals generated for each of the different audio signals.

Thus, whereas the following description focuses on a single audio signal, this may merely be considered as the signal component of an audio signal that corresponds to one sound source out of a plurality of audio signals.

The receiver 301 is coupled to a binaural processor 303 which receives the audio signal and which generates a binaural output signal by processing the audio signal. The binaural processor 303 is coupled to a pair of headphones 305 which is fed the binaural signal. Thus, the binaural signal comprises a signal for the left ear and a signal for the right ear.

It will be appreciated that whereas the use of headphones may be typical for many applications, the described invention and principles are not limited thereto. For example, in some situations, sound may be rendered through loudspeakers in front of the user or to the sides of the user (e.g. using a shoulder mounting device). In some scenarios, the binaural processing may in such cases be enhanced with additional processing that compensates for cross-talk between the two loudspeakers (e.g. it can compensate the right loudspeaker signal for the sound components of the left speaker that are also heard by the right ear).

The binaural processor 303 is arranged to process the audio signal processing such that the processing is representative of a binaural transfer function which provides a virtual sound source position for the audio signal in the binaural output signal. In the system of FIG. 3, the binaural transfer function is the transfer function applied to the audio signal to generate the binaural output signal. It thus reflects the combined effect of the processing of binaural processor 303 and may in some embodiments include non-linear effects, feedback effects etc.

As part of the processing, the binaural processor 303 may apply a virtual positioning binaural transfer function to the signal being processed. Specifically, as part of the signal path from the audio signal to the binaural output signal, a virtual positioning binaural transfer function is applied to the signal.

The binaural transfer function specifically includes a Head Related Transfer Function (HRTF), a Head Related Impulse Response (HRIR) and/or a Binaural Room Impulse Responses (BRIRs). The terms impulse response and transfer function are considered to be equivalent. Thus, the binaural output signal is generated to reflect the audio conditioning introduced by the listeners head and typically the room such that the audio signal appears to originate at the desired position.

Figure 4:
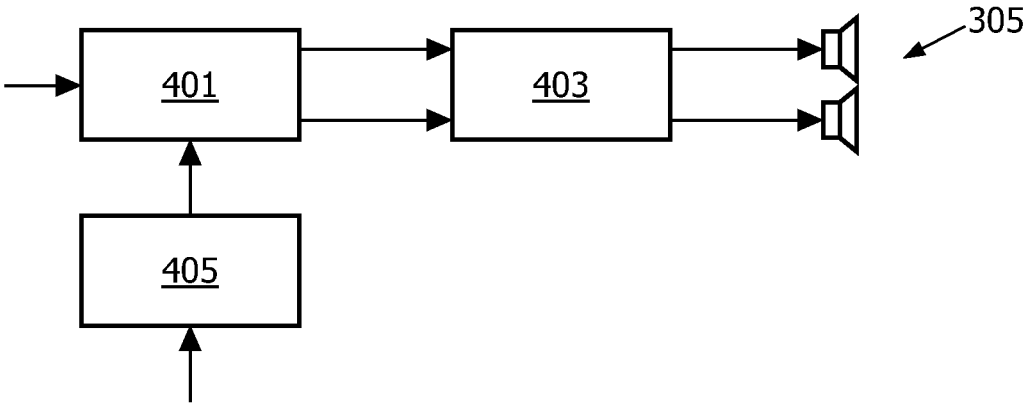
FIG. 4 illustrates an example of elements of a binaural processor in accordance with some embodiments of the invention.

FIG. 4 illustrates an example of the binaural processor 303 in more detail. In the specific example, the audio signal is fed to a binaural signal processor 401 which proceeds to filter the audio signal in accordance with the binaural transfer function. The binaural signal processor 401 comprises two subfilters, namely one for generating the signal for the left ear channel and one for generating the signal for the right ear channel. In the example of FIG. 4, the generated binaural signal is fed to an amplifier 403 which amplifies the left and right signals independently and then feeds them to the left and right speakers of the headphones 305 respectively.

The filter characteristics for the binaural signal processor 401 depend on the desired virtual position for the audio signal. In the example, the binaural processor 303 comprises a coefficient processor 405 which determines the filter characteristics and feeds these to the binaural signal processor 401. The coefficient processor 405 may specifically receive a position indication and select the appropriate filter components accordingly.

In some embodiments, the audio signal may e.g. be a time domain signal and the binaural signal processor 401 may be a time domain filter, such as an IIR or FIR filter. In such a scenario, the coefficient processor 405 may e.g. provide the filter coefficients. As another example, the audio signal may be converted to the frequency domain and the filtering may be applied in the frequency domain, e.g. by multiplying each frequency component by a complex value corresponding to the frequency transfer function of the filter. In some embodiments, the processing may be entirely performed on time-frequency tiles.

It will be appreciated that in some embodiments, other processing may also be applied to the audio signal, for example a high pass filtering or low pass filtering may be applied. It will also be appreciated that the virtual sound positioning binaural processing may be combined with other processing. For example, an upmixing operation of the audio signal in response to spatial parameters may be combined with the binaural processing. For example, for an MPEG Surround signal, an input signal represented by time frequency tiles may be upconverted to different spatial signals by applying different spatial parameters. Thus, for a given upmixed signal, each time-frequency tile may be subjected to a multiplication by a complex value corresponding to the spatial parameter/upmixing. The resulting signal may then be subjected to the binaural processing by multiplying each time-frequency tile by a complex value corresponding to the binaural transfer function. Of course, in some embodiments, these operations may be combined such that each time-frequency tile may be multiplied by a single complex value which represents both the upmixing and the binaural processing (specifically it may correspond to the multiplication of the two separate complex values).

In conventional binaural virtual spatial audio, the binaural processing is based on predetermined binaural transfer functions that have been derived by measurements, typically using microphones positioned in the ears of a dummy. For HRTFs and HRIRs, only the impact of the user and not the environment is taken into account. However, when BRIRs are used, the room characteristics of the room in which the measurement was taken are also included. This may provide an improved user experience in many scenarios. Indeed, it has been found that when virtual surround audio over headphones is reproduced in the room where the measurements were made, a convincing externalization can be obtained. However, in other environments, and in particular in environments wherein the acoustic characteristics are very different (i.e. where there is a clear mismatch between the reproduction and measurement room), the perceived externalization can degrade significantly.

In the system of FIG. 3, such degradation is significantly mitigated and reduced by adapting the binaural processing.

Specifically, the audio system of FIG. 3 further comprises a measurement circuit 307 which performs real world measurement that is dependent or reflects the acoustic environment in which the system is used. Thus, the measurement circuit 307 generates measurement data which is indicative of a characteristic of the acoustic environment.

In the example, the system is coupled to a microphone 309 which captures audio signals but it will be appreciated that in other embodiments other sensors and other modalities may additionally or alternatively be used.

The measurement circuit 307 is coupled to a parameter processor 311 which receives the measurement data and which proceeds to generate an acoustic environment parameter in response thereto. Thus, a parameter is generated which is indicative of the specific acoustic environment in which the virtual sound is rendered. For example, the parameter may indicate how echoic or reverberant the room is.

The parameter processor 311 is coupled to an adaptation processor 313 which is arranged to adapt the binaural transfer function used by the binaural processor 303 dependent on the determined acoustic environment parameter. For example, if the parameter is indicative of a very reverberant room, the binaural transfer function may be modified to reflect a higher degree of reverberation than measured by the BRIR.

Thus, the system of FIG. 3 is capable of adapting the rendered virtual sound to more closely reflect the audio environment in which it is used. This may provide a more consistent and naturally seeming virtual sound provision. In particular, it may allow visual positional cues to more closely align with the provided audio positional cues.

The system may dynamically update the binaural transfer function and this dynamic updating may in some embodiments be performed in real time. For example, the measurement processor 307 may continuously perform measurements and generate current measurement data. This may be reflected in a continuously updated acoustic environment parameter and a continuously updated adaptation of the binaural transfer function. Thus, the binaural transfer function may continuously be modified to reflect the current audio environment.

This may provide a very attractive user experience. As a specific example, a bathroom tends to be dominated by very hard and acoustically very reflective surfaces with little attenuation. In contrast, a bedroom tends to be dominated by soft and attenuating surfaces, in particular for higher frequencies. Thus, a person wearing a pair of headphones providing virtual surround sound will with the system of FIG. 3 be able to be provided with a virtual sound that automatically adjusts when the user walks from the bathroom to the bedroom or vice versa. Thus, when the user exits the bathroom and enters the bedroom, the sound may automatically become less reverberant and echoic to reflect the new acoustic environment.

It will be appreciated that the exact acoustic environment parameter used may depend on the preferences and requirements of the individual embodiment. However, in many embodiments, it may be particularly advantageous for the acoustic environment parameter to comprise a reverberation parameter for the acoustic environment.

Indeed, reverberation is not only a characteristic that can be relatively accurately measured using relatively low complexity approaches but is also a characteristic that has a particularly significant impact on the user's audio perception, and in particular on the user's spatial perception. Thus, in some embodiments, the binaural transfer function is adapted in response to a reverberation parameter for the audio environment.

It will be appreciated that the specific measurement and measured parameters will also depend on the specific requirements and preferences of the individual embodiment. In the following various advantageous examples of the acoustic environment parameter and methods of generating this will be described.

In some embodiments, the acoustic environment parameter may comprise a parameter indicative of a reverberation time for the acoustic environment. The reverberation time may be defined as the time it takes for reflections to be reduced to a specific level. For example the reverberation time may be determined as the time that it takes for the energy level of reflections to drop 60 dB. This value is typically denoted by T60.

The reverberation time T60 may e.g. be determined by:

$$T_{60} \cong \frac{0.163 \cdot V}{a},$$

where V is the volume of the room and a is an estimate of the equivalent absorption area.

In some embodiments, predetermined characteristics of the room (such as V and a) may be known for a number of different rooms. The audio system may have various such parameters stored (e.g. following a user manually inputting the values). The system may then proceed to perform measurements that simply determine which room the user is currently located in. The corresponding data may then be retrieved and used to calculate the reverberation time. The determination of the room may be by comparison of audio characteristics to measured and stored audio characteristics in each room. As another example, a camera may capture an image of the room and use this to select which data should be retrieved. As yet another example, the measurement may include a position estimation and the appropriate data for the room corresponding to that position may be retrieved. In yet another example, user-preferred acoustical rendering parameters are associated with location information derived from GPS cells, proximity of specific WiFi access points, or a light sensor that discriminates between artificial or natural light to determine whether the user is inside or outside a building.

As another example, the reverberation time may be determined by specific processing of two microphone signals as described in more detail in Vesa, S., Harma, A. (2005). Automatic estimation of reverberation time from binaural signals. ICASSP 2005, p. iii/281-iii/284 March 18-23.

In some embodiments, the system may determine an impulse response for the acoustic environment. The impulse response may then be used to determine the acoustic environment parameter. For example, the impulse may be evaluated to determine the duration before the level of the impulse response has reduced to a certain level, e.g. the T60 value is determined as the duration of the impulse response until the response has dropped by 60 dB.

It will be appreciated that any suitable approach for determining the impulse response may be used.

For example, the system may include a circuit that generates a sound test signal which is radiated into the acoustic environment. E.g. the headphones may contain an external speaker or another speaker unit may e.g. be used.

The microphone 309 may then monitor the audio environment and the impulse response is generated from the captured microphone signal. For example, a very short pulse may be radiated. This signal will be reflected to generate echoes and reverberation. Thus, the test signal may approximate a Dirac impulse, and the signal captured by the microphone may accordingly in some scenarios directly reflect the impulse response. Such an approach may be particularly suitable for very quiet environments where no interference from other audio sources is present. In other scenarios, the test signal may be a known signal (such as a pseudo noise signal) and the microphone signal may be correlated with the test signal to generate the impulse response.

In some embodiments, the acoustic environment parameter may comprise an indication of a reverberation energy relative to a direct path energy. For example, for a measured (discretely-sampled) BRIR h[n], the direct sound energy to reverb energy ratio R can be determined as:

$$R = \frac{\sum_{n=0}^{T} h^2[n]}{\sum_{n=T+1}^{\infty} h^2[n]},$$

where T is a suitable threshold to discriminate between direct and reverberant sound (typically 5-50 ms).

In some embodiments, the acoustic environment parameter may reflect the frequency spectrum of at least part of a room impulse response. For example, the impulse response may be transformed to the frequency domain, e.g. using an FFT, and the resulting frequency spectrum may be analysed.

For example, a modal density may be determined. A mode corresponds to a resonance or standing wave effect for audio in the room. The modal densities may accordingly be detected from peaks in the frequency domain. The presence of such modal densities may impact the sounds in the room, and thus the detection of the modal density may be used to provide a corresponding impact on the rendered virtual sound.

It will be appreciated that in other scenarios, a modal density may e.g. be calculated from characteristics of the room and using well known formulas. For example, modal densities can be calculated from knowledge of the room size. Specifically, the modal density can be calculated as:

$$\frac{dN_f}{df} \cong \frac{4\pi V}{c^3} f^2,$$

where c is the speed of sound and f the frequency.

In some embodiments, an echo density may be calculated. The echo density reflects how many and how close together echoes are in the room. For example, in a small bathroom, there tends to be a relatively high number of relatively close echoes whereas in a large bedroom there tends to be a smaller number of echoes that are not as close together (and not as powerful). Such echo density parameters may thus advantageously be used to adapt the virtual sound rendering and may be calculated from the measured impulse response.

The echo density may be determined from the impulse response or may e.g. be calculated from the room characteristics using well known formulas. For example, the temporal echo density may be calculated as:

$$\frac{dN_t}{dt} \cong \frac{4\pi c^3}{V} t^2,$$

where t is the time lag.

In some embodiments, it may be advantageous to simply evaluate the level of early reflections. For example, a short impulse test signal may be radiated and the system may determine the combined signal level of the microphone signal in a given time interval, such as e.g. the 50 msec following the transmission of the impulse. The energy received in that time interval provides a low complexity yet very useful measure of the significance of early echoes.

In some embodiments, the acoustic environment parameter may be determined to reflect an inter-aural coherence/correlation. The correlation/coherence between the two ears may e.g. be determined from signals from two microphones positioned in the left and right earpiece respectively. The correlation between the ears may reflect the diffuseness and may provide a particularly advantageous basis for amending the rendered virtual sound as diffuseness gives an indication of how reverberant the room is. A reverberant room will be more diffuse than a room with little or no reverberation.

In some embodiments, the acoustic environment parameter may simply be, or comprise, a room size estimate. Indeed, as clearly can be seen from the previous examples, the room size has significant effect on the sound characteristics of the room. In particular, echoes and reverberation depends heavily thereon. Therefore, in some scenarios the adaption of the rendered sound may simply be based on a determination of a room size based on a measurement.

It will be appreciated that other approaches than determining the room impulse response can be used. For example, the measurement system may alternatively or additionally use other modalities such as vision, light, radar, ultrasound, laser, camera or other sensory measurements. Such modalities may be particularly suitable for estimating the room size from which reverberation characteristics can be determined. As another example, they may be suitable for estimating reflection characteristics (e.g. the frequency response of wall reflections). For example, a camera may determine that the room corresponds to a bath room and may accordingly assume reflection characteristics corresponding to typical tiled surfaces. As another example, absolute or relative location information may be used.

As yet another example, an ultrasound range determination based on ultrasonic sensors and radiation of an ultrasonic test signal may be used to estimate the size of the room. In other embodiments, light sensors may be used to get a light-spectrum based estimate (e.g. evaluating whether it detects natural or artificial light thereby allowing a differentiation between an inside or outside environment). Also location information could be useful based on GPS. As another example, detection and recognition of certain WiFi access points or GSM cell identifiers could be used to identify which binaural transfer function to use.

It will also be appreciated that although audio measurements may in many embodiments advantageously be based on radiation of an audio test signal, some embodiments may not utilise a test signal. For example, in some embodiments, the determination of audio characteristics, such as reverberation, frequency response or an impulse response may be done passively by analyzing sounds that are produced by other sources in the current physical room (e.g. footsteps, radio, etc).

In the system of FIG. 3, the processing of the binaural processor 303 is then modified in response to the acoustic environment parameter. Specifically, the binaural signal processor 401 processes the audio signal in accordance with the binaural transfer function where the binaural transfer function is dependent on the acoustic environment parameter.

In some embodiments, the binaural signal processor 401 may comprise a data store which stores binaural transfer function data corresponding to a plurality of different acoustic environments. For example, one or more BRIRs may be stored for a number of different room types, such as a typical bathroom, bedroom, living room, kitchen, hall, car, train etc. For each type, a plurality of BRIRs may be stored corresponding to different room sizes. Characteristics of the room in which the BRIR was measured is further stored for each BRIR.

The binaural signal processor 401 may further comprise a processor which is arranged to receive the acoustic environment parameter and to in response retrieve appropriate binaural transfer function data from the store. For example, the acoustic environment parameter may be a composite parameter comprising a room size indication, an indication of the ratio between early and late energy, and a reverberation time. The processor may then search through the stored data to find the BRIR for which the stored room characteristics most closely resemble the measured room characteristics.

The processor then retrieves the best matching BRIR and applies it to the audio signal to generate the binaural signal which after amplification is fed to the headphones.

In some embodiments, the data store may be dynamically updated and/or developed. For example, when a user is in a new room, the acoustic environment parameter may be determined and used to generate a BRIR that matches that room. The BRIR may then be used to generate the binaural output signal. However, in addition, the BRIR may be stored in the data store together with appropriate determined characteristics of the room, such as the acoustic environment parameter, possibly a position, etc. In this way, the data store may dynamically be built up and enhanced with new data as and when this is generated. The BRIR may then be used subsequently without having to determine it from first principles. For example, when a user returns to a room in which he has previously used the device, this will automatically be detected and the stored BRIR is retrieved and used to generate the binaural output signal. Only if no suitable BRIR is available will it be necessary to generate a new one (which can then be stored). Such an approach may reduce complexity and processing resource.

In some embodiments, the binaural signal processor 401 comprises two signal processing blocks. A first block may perform processing corresponding to a predetermined/fixed virtual position binaural transfer function. Thus, this block may process the input signal in accordance with a reference BRIR, HRIR or HRTF that may be generated based on reference measurements, e.g. during the design of the system. The second signal processing block may be arranged to perform room simulation in response to the acoustic environment parameter. Thus, in this example, the overall binaural transfer function includes a contribution from a fixed and predetermined BRIR, HRIR or HRTF and for an adaptive room simulation process. The approach may reduce complexity and facilitate design. For example, it is in many embodiments possible to generate accurate room adaptation without the room simulation processing considering the specific desired virtual positioning. Thus, the virtual positioning and the room adaptation may be separated with each individual signal processing block having to consider only one of these aspects.

For example, the BRIR, HRIR or HRTF may be selected to correspond to the desired virtual position. The resulting binaural signal may then be modified to have a reverberation characteristic that matches that of the room. However, this modification may be considered independent of the specific position of the audio sources, such that only the acoustic environment parameter needs to be considered. This approach may significantly facilitate room simulation and adaptation.

Figure 5:
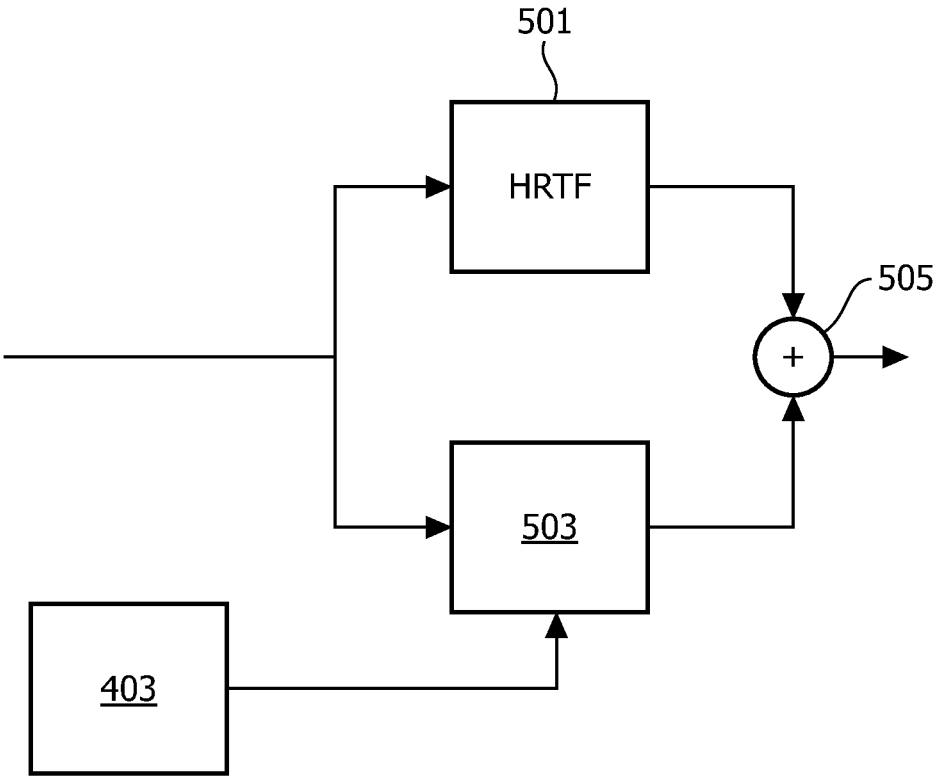
FIG. 5 illustrates an example of elements of a binaural signal processor in accordance with some embodiments of the invention.
Figure 6:
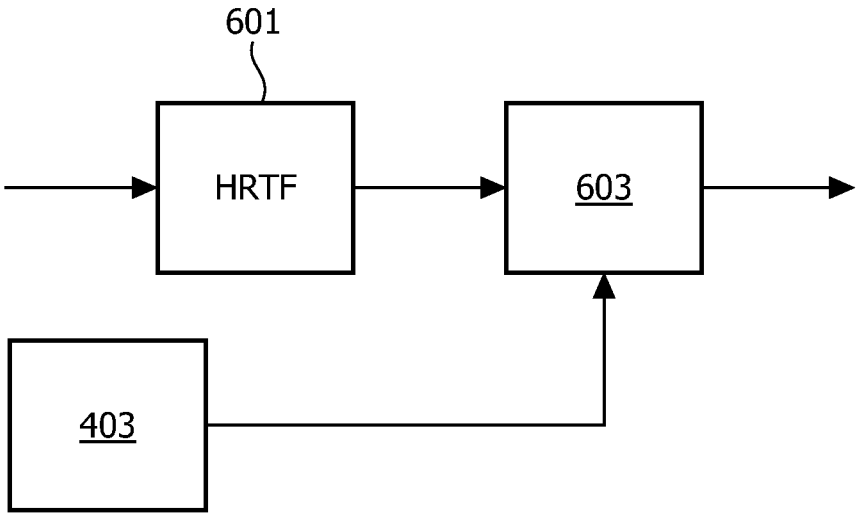
FIG. 6 illustrates an example of elements of a binaural signal processor in accordance with some embodiments of the invention.

The individual processing may be performed in parallel or in series. FIG. 5 illustrates an example where a fixed HRTF processing 501 and a variable adaptive room simulation processing 503 are applied to the audio signal in parallel. The resulting signals are then combined by a simple summation 505. FIG. 6 illustrates an example where a fixed HRTF processing 601 and a variable adaptive room simulation processing 603 are performed in series such that the adaptive room simulation processing is applied to the binaural signal generated by the HRTF processing. It will be appreciated that in other embodiments, the order of the processing may be reversed.

In some embodiments, it may be advantageous to apply the fixed HRTF processing individually to each channel and to apply the variable adaptive room simulation processing at once on a mix of all the channels in parallel.

The binaural signal processor 401 may specifically try to modify the binaural transfer function such that the output binaural signal from the audio system has characteristics that more closely resembles the characteristic(s) reflected by the acoustic environment parameter. For example, for an acoustic environment parameter indicating a high reverberation time, the reverberation time of the generated output binaural signal is increased. In most embodiments, a reverberation characteristic is a particularly suitable parameter to adapt to provide a closer correlation between the generated virtual sound and the acoustic environment.

This may be achieved by modifying the room simulation signal processing 503, 603 of the binaural signal processor 401.

In particular, the room simulation signal processing 503, 603 may in many embodiments comprise a reverberator which is adapted in response to the acoustic environment parameter.

The level of early reflections can be controlled by adjusting the level of, at least part of, the impulse response of the reverberant part including the early reflections relative to the level of the HRIR, HRTF or BRIR.

Thus, a synthetic reverberation algorithm may be controlled based on the estimated room parameters.

Various synthetic reverberators are known and it will be appreciated that any suitable such reverberator can be used.

Figure 7:
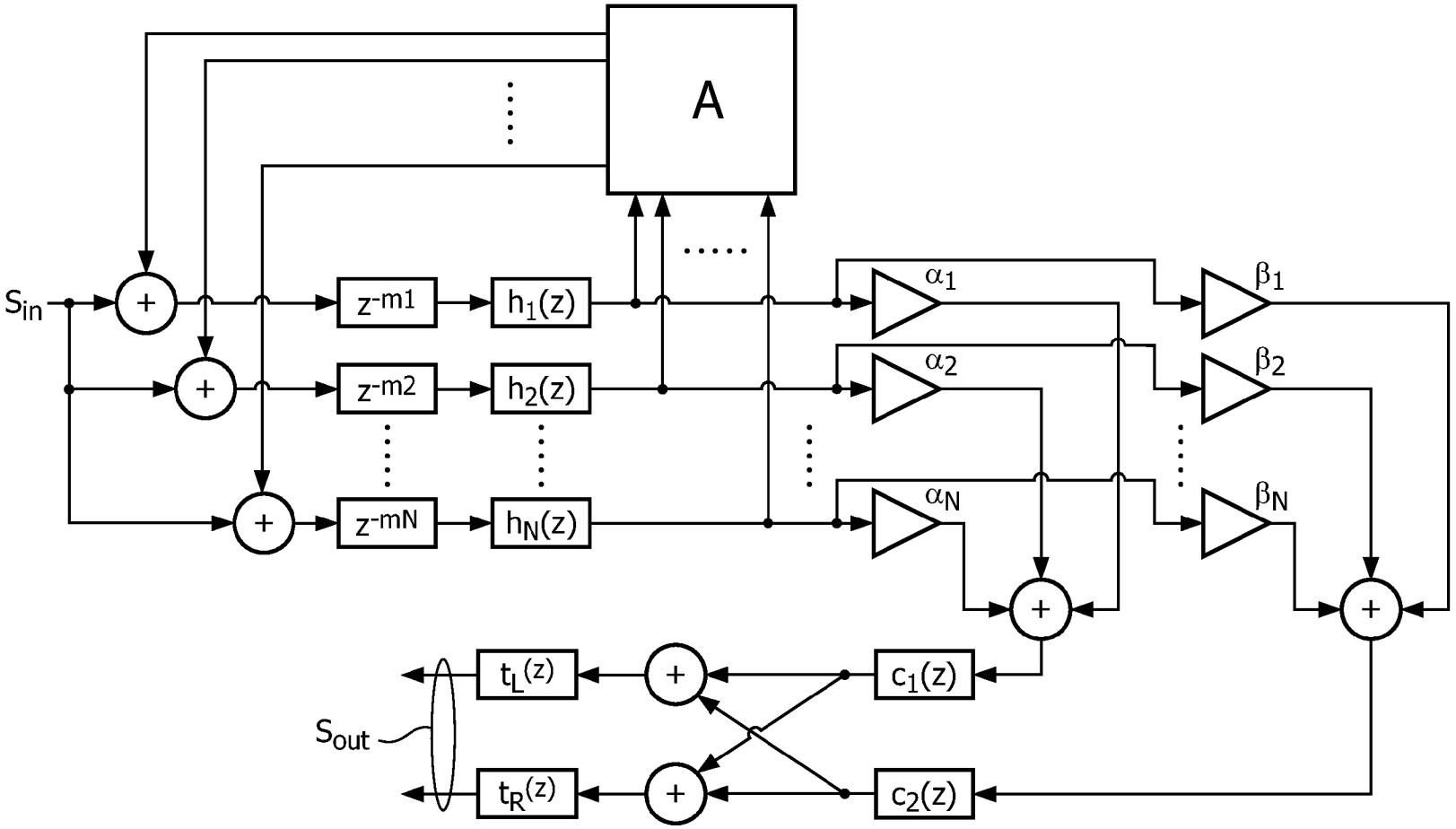
FIG. 7 illustrates an example of elements of a Jot reverberator.

FIG. 7 shows a specific example of the room simulation signal processing block being implemented as a unitary feedback network reverberator, and specifically as a Jot reverberator.

The room simulation signal processing 503, 603 may proceed to adapt the parameters of the Jot reverberator to modify the characteristics of the binaural output signal. Specifically, it can modify one or more of the characteristics previously described for the acoustic environment parameter.

Indeed, in the example of the Jot reverberator of FIG. 7, the modal and echo densities can be modified by changing the relative and absolute values of the delays (mi). By adapting the value of gains in the feedback loops the reverberation time can be controlled. Further, a frequency dependent T60 can be controlled by replacing the gains with appropriate filters (hi(z)).

For binaural reverberations the outputs of the N branches can be combined in different ways ($\alpha i$, $\beta i$), making it possible to generate two reverb tails with a correlation of 0. A pair of jointly designed filters (c1($z$), c2($z$)) can consequently be employed to control the ICC of the two reverb outputs.

Another filter (tL(z), tR(z)) in the network, can be used to control the spectral equalization of the reverb. Also the overall gain of the reverb can be incorporated in this filter, thereby allowing control over the ratio between the direct portion and reverb portion, i.e. of reverberation energy relative to a direct sound energy.

Further detail on the use of a Jot reverberator, specifically on the relation between time- and frequency density and reverberator parameters, and the translation of a desired frequency dependent T60 to reverberator parameters, can be found in Jean-Marc Jot and Antoine Chaigne (1991) Digital delay networks for designing artificial reverberations, proc. $90^{th}$ AES convention.

Further detail on the use of a binaural Jot reverberator and specifically on how to translate desired inter-aural coherence/correlation and coloration to reverberator parameters can be found in Fritz Menzer and Christof Faller (2009) Binaural reverberation using a modified Jot reverberator with frequency-dependent interaural coherence matching, proc. $126^{th}$ AES convention.

In some embodiments, the acoustic environment parameter and binaural transfer function may be dynamically modified to continuously adapt the rendered sound to the acoustic environment. However, in other embodiments, the binaural transfer function may only be modified when the acoustic environment parameter meets a criterion. Specifically, the requirement may be that the acoustic environment parameter must differ by more than a given threshold from the acoustic environment parameter that was used to set the current processing parameters. Thus, in some embodiments the binaural transfer function is only updated if the change in the room characteristic(s) exceeds a certain level. This may in many scenarios provide an improved listening experience with a more static rendering of sound.

In some embodiments, the modification of the binaural transfer function may be instantaneous. For example, if a different reverberation time is suddenly measured (e.g. due to the user having moved to a different room), the system may instantly change the reverberation time for the sound rendering to correspond thereto. However, in other embodiments, the system may be arranged to restrict the speed of change and thus to gradually modify the binaural transfer function. For example, the transition may be gradually implemented over a time interval of, say, 1-5 seconds. The transition may for example be achieved by an interpolation of the target values for the binaural transfer function or may e.g. be achieved by a gradual transition of the acoustic environment parameter value used for adapting the processing.

In some embodiments, the measured acoustic environment parameter and/or the corresponding processing parameters may be stored for later user. E.g. the user may subsequently select from previously determined values. Such a selection could also be performed automatically, e.g. by the system detecting that the characteristics of the current environment closely reflect characteristics previously measured. Such an approach may be practical for scenarios wherein a user frequently moves in and out of a room.

In some embodiments, the binaural transfer function is adapted on a per room basis. Indeed, the acoustic environment parameter may reflect characteristics of the room as a whole. The binaural transfer function is thus updated to simulate the room and provide the virtual spatial rendering when taking the room characteristics into account.

In some embodiments, the acoustic environment parameter may however not only reflect the acoustic characteristics for the room but may also reflect the user's position within the room. For example, if a user is close to a wall, the ratio between early reflections and late reverberation may change and the acoustic environment parameter may reflect this. This may cause the binaural transfer function to be modified to provide a similar ratio between early reflections and late reverberation. Thus, as the user moves towards a wall, the direct early echoes become more significant in the rendered sound and the reverberation tail is reduced. When the user moves away from the wall, the opposite happens.

In some embodiments, the system may be arranged to update the binaural transfer function in response to a user position. This may be done indirectly as described in the above example. Specifically, the adaptation may occur indirectly by determining an acoustic environment parameter that is dependent on the user's position and specifically which is dependent on the user's position within a room.

In some embodiments, a position parameter indicative of a user position may be generated and used to adapt the binaural transfer function. For example, a camera may be installed and use visual detection techniques to locate a user in the room. The corresponding position estimate may then be transmitted to the audio system (e.g. using wireless communications) and may be used to adapt the binaural transfer function.

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by e.g. a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. An audio system comprising:

a receiver for receiving an audio signal;

a binaural circuit for generating a binaural output signal by processing the audio signal, the processing being representative of a binaural transfer function providing a virtual sound source position for the audio signal;

a measurement circuit for generating measurement data indicative of a characteristic of an acoustic environment;

a determining circuit for determining an acoustic environment parameter in response to the measurement data; and an adaptation circuit for adapting the binaural transfer function in response to the acoustic environment parameter, wherein the adaptation circuit is arranged to dynamically modify the binaural transfer function to provide a closer match between a characteristic for the generated virtual sound and the acoustic environment, and wherein the adaptation circuit is arranged to adapt a reverberation characteristic of the binaural transfer function to more closely resemble the reverberation characteristics of the acoustic environment.

2. The audio system of claim 1 wherein the acoustic environment parameter comprises a reverberation parameter for the acoustic environment.

3. The audio system of claim 1 wherein the acoustic environment parameter comprises at least one of:

a reverberation time;

a reverberation energy relative to a direct path energy;

a frequency spectrum of at least part of a room impulse response;

a modal density of at least part of a room impulse response;

an echo density of at least part of a room impulse response;

an inter-aural coherence or correlation;

a level of early reflections; and a room size estimate.

4. The audio system of claim 1 wherein the adaptation circuit is arranged to adapt at least one of the following characteristics of the binaural transfer function:

a reverberation time;

a reverberation energy relative to a direct sound energy;

a frequency spectrum of at least part of the binaural transfer function;

a modal density of at least part of the binaural transfer function;

an echo density of at least part of the binaural transfer function;

an inter-aural coherence or correlation; and a level of early reflections of at least part of the binaural transfer function.

5. The audio system of claim 1 wherein the processing comprises a combination of a predetermined binaural transfer function and a variable binaural transfer function adapted in response to the acoustic environment parameter.

6. The audio system of claim 1 wherein the adaptation circuit is arranged to modify the binaural transfer function only when the environment characteristic meets a criterion.

7. The audio system of claim 1 wherein the adaptation circuit is arranged to modify gradually over a time interval the binaural transfer function.

8. The audio system of claim 1 further comprising:

a data store for storing binaural transfer function data;

a circuit for retrieving binaural transfer function data from the data store in response to the acoustic environment parameter; and wherein the adaptation circuit is arranged to adapt the binaural transfer function in response to the retrieved binaural transfer function data.

9. The audio system of claim 1 further comprising:

a test signal circuit arranged to radiate a sound to signal into the acoustic environment; and wherein the measurement circuit is arranged to capture a received sound signal in the environment, the received audio signal comprising a signal component arising from the radiated sound test signal; and the determining circuit is arranged to determine the acoustic environment parameter in response to the sound test signal.

10. The audio system of claim 9 wherein the determining circuit is arranged to determine an environment impulse response in response to the received sound signal and to determine the acoustic environment parameter in response to the environment impulse response.

11. The audio system of claim 1 wherein the adaptation circuit is further arranged to update the binaural transfer function in response to a user position.

12. The audio system of claim 1 wherein the binaural circuit comprises a reverberator; and the adaptation circuit is arranged Co adapt a reverberation processing of the reverberator in response to the acoustic environment parameter.

13. A method of operation for an audio system, the method comprising:

receiving an audio signal;

generating a binaural output signal by processing the audio signal, the processing being representative of a binaural transfer function providing a virtual sound source position for the audio signal;

generating measurement data indicative of a characteristic of an acoustic environment;

determining an acoustic environment parameter in response to the measurement data; and adapting the binaural transfer function in response to the acoustic environment parameter, said adapting being arranged to dynamically modify the binaural transfer function to provide a closer match between a characteristic for the generated virtual sound and the acoustic environment, and wherein the binaural transfer function is arranged to adapt a reverberation characteristic of the binaural transfer function to more closely resemble the reverberation characteristics of the acoustic environment.

14. The method of claim 13, wherein the binaural transfer function is arranged to be modified only when the characteristic for the acoustic environment meets a criterion.

15. The method of claim 13, wherein the binaural transfer function is arranged to be modified gradually over a time interval.

16. The method of claim 13 wherein the binaural transfer function is arranged to be modified in response to a user position.

17. The method of claim 13, wherein the step of determining the acoustic environment parameter, further comprises:

radiating a sound test signal into the acoustic environment;

capturing a received sound signal in the environment, the received audio signal comprising a signal component arising from the radiated sound test signal;

determining the acoustic environment parameter in response to the sound test signal.

18. The method of claim 13, wherein the processing comprises a combination of a predetermined binaural transfer function and a variable binaural transfer function adapted in response to the acoustic environment parameter.

* * * * *